US006014532A

United States Patent [19]

Takeichi et al.

[11] Patent Number: 6,014,532

[45] Date of Patent: Jan. 11, 2000

[54] IMAGE FORMING APPARATUS

[75] Inventors: Ryuta Takeichi, Kanagawa; Yukiko Iwasaki, Tokyo; Akiyo Nakajima, Kanagawa; Hiroshi Nagame, Shizuoka; Narihito Kojima, Shizuoka; Hiroyuki Fushimi, Shizuoka, all of Japan

[73] Assignee: Ricoh Company, Ltd., Tokyo, Japan

[21] Appl. No.: 09/184,864

[22] Filed: Nov. 3, 1998

[30] Foreign Application Priority Data

Nov. 7, 1997 [JP] Japan ..... 9-322116

[51] Int. Cl.[7] ..... G03G 15/00

[52] U.S. Cl. ..... 399/71; 399/346

[58] Field of Search ..... 399/49, 72, 346, 399/71

[56] References Cited

U.S. PATENT DOCUMENTS

| | | | |
|---|---|---|---|
| 5,264,903 | 11/1993 | Nagame et al. . | |
| 5,390,015 | 2/1995 | Nagame et al. . | |
| 5,450,165 | 9/1995 | Henderson | 399/49 |
| 5,452,061 | 9/1995 | Kojima et al. . | |
| 5,606,408 | 2/1997 | Yano et al. . | |
| 5,619,316 | 4/1997 | Shoji et al. . | |
| 5,812,919 | 9/1998 | Takano et al. | 399/312 |

FOREIGN PATENT DOCUMENTS

| | | |
|---|---|---|
| 7-311531 | 11/1995 | Japan . |
| 8-137354 | 5/1996 | Japan . |
| 8-234642 | 9/1996 | Japan . |
| 8-254933 | 10/1996 | Japan . |
| 8-305233 | 11/1996 | Japan . |

*Primary Examiner*—Robert Beatty

*Attorney, Agent, or Firm*—Oblon, Spivak, McClelland, Maier & Neustadt, P.C.

[57] ABSTRACT

An image forming apparatus capable of adequately adjusting the amount of a low friction agent to be applied to the surface of a photoconductive element in accordance with image quality is disclosed. After preselected initialization, an electrophotographic image forming section records a usual image or a particular image for evaluation on a paper. A toner image formed on the photoconductive element and a toner image transferred from the element to a paper are read. Image data representative of such toner images and the initial image data are compared to see if the read images are defective or not. The low friction agent is applied to the photoconductive element in an amount controlled on the basis of the result of the decision.

6 Claims, 13 Drawing Sheets

IMAGE FORMING APPARATUS

BACKGROUND OF THE INVENTION

The present invention relates to an electrophotographic image forming apparatus and, more particularly, to an image forming apparatus capable of adjusting the amount of a low friction agent to be applied to the surface of a photoconductive element on the basis of image quality.

It is a common practice with an electrophotographic copier, printer, facsimile apparatus or similar image forming apparatus to scan a uniformly charged photoconductive element with a beam modulated by image data so as to electrostatically form a latent image thereon. The latent image is developed by toner fed from a developing section to turn out a corresponding toner image. The toner image is transferred from the photoconductive element to a paper or similar recording medium at an image transfer station and then fixed by heat and pressure at a fixing station. After the image transfer, the toner left on the photoconductive element is removed by, e.g., a cleaning blade located at a cleaning station.

It has been customary with the above apparatus to apply a lubricant to the surface of the photoconductive element. The lubricant lowers the coefficient of friction on the surface of the photoconductive element and thereby prevents needless toner from depositing on the element, so that the background of the resulting image is free from contamination. The lubricant is applied and then scraped off in order to refresh the photoconductive element at all times, thereby extending the life of the element.

Particularly, in an image forming apparatus of the type removing toner left on a photoconductive element with a cleaning blade, the low friction agent applied to the element successfully lowers the coefficient of friction between the element and the blade at the time of cleaning and thereby extends the life of the element.

Specifically, the wear of a photoconductive layer formed on the photoconductive element is one of major factors determining the life of the element. Should the photoconductive layer become worn by more than a preselected amount, the electric characteristic of the photoconductive element would vary too much to effect an adequate image forming process. While the wear occurs at all the positions where the photoconductive element contacts a developing section, an image transfer section and so forth, the cleaning blade dynamically removing the toner from the element is most critical. The wear at the other stations does not have substantial influence on the life of the photoconductive element. As for the cleaning station, the wear is generally classified into two different kinds of wear, i.e., one ascribable to a shearing force acting between the blade and the photoconductive element and the other ascribable to the toner behaving like a whetstone between the blade and the element. Factors determining such wear include the structural strength of the photoconductive element, the contact pressure of the blade contacting the element, the composition of toner particles, and the coefficient of friction of the surface of the element.

Therefore, by reducing the coefficient of friction of the photoconductive element with the low friction agent, it is possible to reduce the wear at the cleaning station for thereby extending the life of the element. In light of this, an image forming apparatus capable of applying a lubricant evenly to the surface of a photoconductive element is taught in, e.g., Japanese Patent Laid-Open Publication No. 8-20226. The apparatus is directed toward the obviation of background contamination ascribable to the unevenness of the lubricant However, the apparatus taught in the above document has some room for further improvement in the image quality aspect, as follows. The low friction agent applied to the photoconductive element lowers the coefficient of friction and thereby reduces adhesion between the toner and the element at the time of development. This prevents the toner from being transferred to the photoconductive element in an expected manner. This is particularly true with, e.g., a two-ingredient type developer developing a latent image in contact with the photoconductive element. Specifically, when particles particular to such a developer contact the surface layer of the photoconductive element, they exert a dynamic force and are likely to scrape off the toner successfully transferred to the element or to displace the toner image away from the expected position. This phenomenon occurs little so long as the coefficient of friction on the surface of the photoconductive element is high. However, when the coefficient of friction is reduced by the low friction agent, the above phenomenon becomes noticeable, depending on the amount of the low friction agent, i.e., the decrease of the coefficient of friction. This phenomenon does not occur in a two-level fashion, i.e., does not occur suddenly on the decrease of the coefficient of friction to a certain value. That is, images sequentially vary in accordance with the variation of the coefficient of friction of the surface of the photoconductive element and appear defective to the eye when varied over a certain degree.

Moreover, various matters deposit on the photoconductive element during development and include NOx, SOx and other ion oxides ascribable to ozone produced at a charging station and an image transfer station due to discharge and dielectric breakdown. Such matters are so hydrophilic, they gather water molecules existing in the air. As a result, the electric resistance of the surface layer of the photoconductive element is lowered. This prevents a latent image formed on the photoconductive element by a beam from holding its charge and thereby disturbs the image.

Usually, the above matters are scraped off by the cleaning blade used to clean the photoconductive element and are not critical in practice. However, the low friction agent applied to the photoconductive element for reducing friction reduces the coefficient of friction and therefore a shearing force to act between the photoconductive layer of the photoconductive element and the blade. This obstructs the removal of the undesirable matters from the photoconductive element and thereby brings about defective images. Again, such defective images do not occur in a two-level fashion.

To solve the above problems, it is necessary to control the amount of the low friction agent to be applied to the photoconductive element for varying the coefficient of friction of the surface of the element.

SUMMARY OF THE INVENTION

It is therefore an object of the present invention to provide an image forming apparatus capable of applying a low friction agent to a photoconductive element within a range insuring high image quality and thereby extending the life of the element and enhancing image quality.

It is another object of the present invention to provide a small size, low cost image forming apparatus capable of enhancing image quality.

In accordance with the present invention, an image forming apparatus for forming an electrostatic latent image on a uniformly charged photoconductive element with a laser beam modulated in accordance with original image data, feeding toner to the photoconductive element to thereby produce a toner image corresponding to the latent image, transferring the toner image to a recording medium, and removing the toner left on the photoconductive element after image transfer to the recording medium includes an applicator for applying a preselected low friction agent to the surface of the photoconductive element. An adjusting section adjusts the amount of the low friction agent to be applied to the surface of the photoconductive element by the applicator. An image reading section reads at least one of the toner image formed on the photoconductive element and the toner image transferred to the recording medium. A controller determines, by comparing toner image data output from the image reading section and the original image data, whether or not the toner image is defective and controls, based on the result of decision, the amount of the low friction agent to be applied to the surface of the photoconductive element via the adjusting section.

The controller may determine, by analyzing the toner image detected by the image data detecting section, whether or not the toner image is defective and control, based on the result of decision, the amount of the low friction agent to be applied to the surface of the photoconductive element via the adjusting section.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
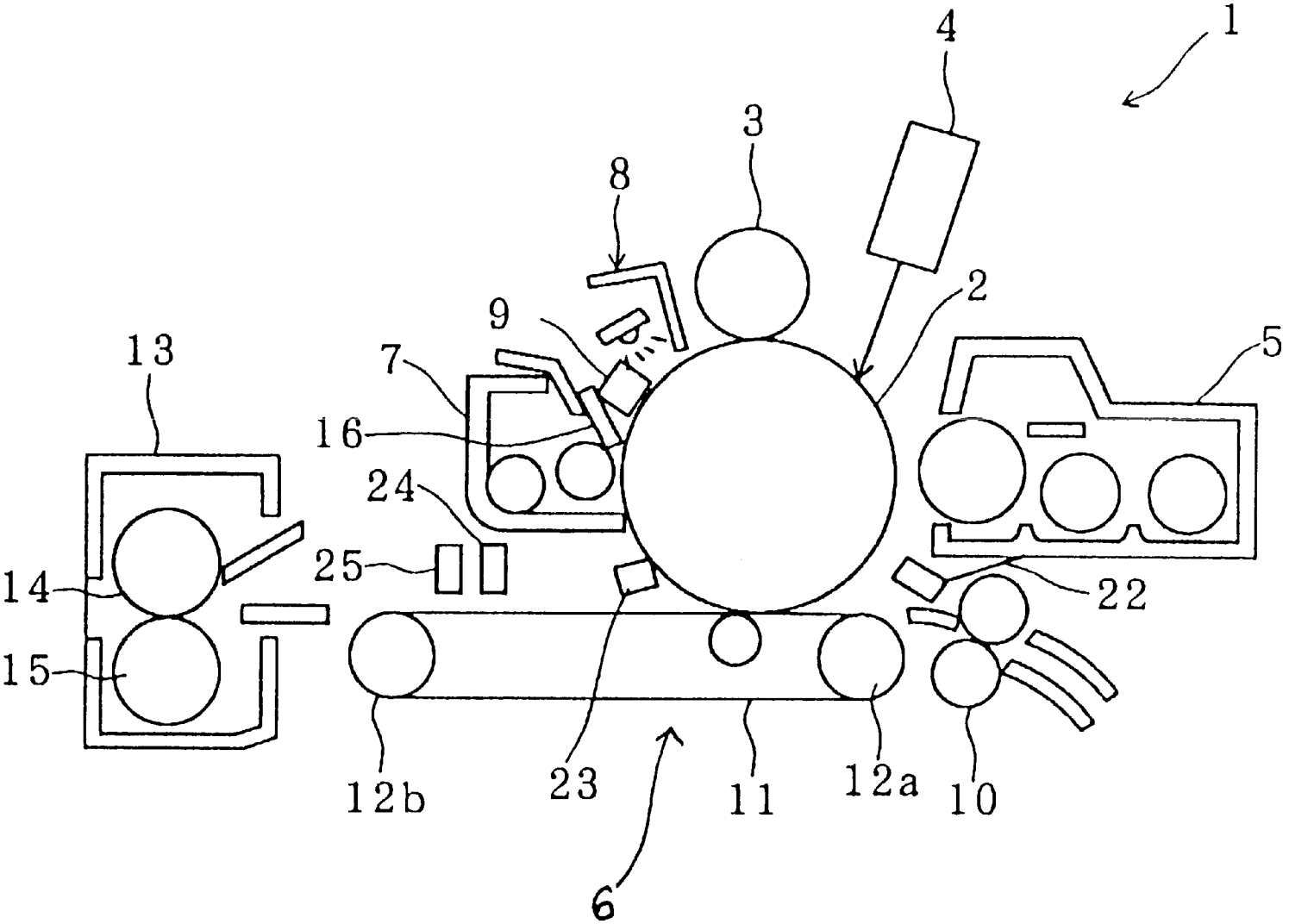
FIG. 1 is a fragmentary front view showing an image forming apparatus embodying the present invention.

Referring to FIG. 1 of the drawings, an image forming apparatus embodying the present invention is shown and generally designated by the reference numeral 1. As shown, the apparatus includes a photoconductive element implemented as a drum 2. Arranged around the drum 2 are a charger 3, optics 4 for writing an image, a developing unit 5, an image transfer section 6, a cleaning unit 7, a discharger 8, etc. A low friction agent applicator 9 is arranged between the cleaning unit 7 and the discharger 8 and held in contact with the drum 2. The drum 2 is rotatable clockwise, as viewed in FIG. 1.

The apparatus 1 further includes a paper cassette, not shown, loaded with a plurality of papers. A pick-up roller, not shown, feeds the papers one by one toward a pair of registration rollers 10. The registration rollers 10 drive the paper reached it toward the image transfer section 6 at a preselected timing.

The image transfer section 6 includes a belt 11 and rollers 12*a* and 12*b* over which the belt 11 is passed. The paper fed from the registration rollers 10 is passed through a nip between the belt 11 and the drum 2. The image transfer section 6 transfers a toner image formed on the drum 2 to the paper while conveying the paper toward the fixing unit 13.

The fixing unit 13 includes a heat roller 14 and a press roller 15 pressed against the heat roller 14 by a preselected pressure. The heat roller 14 is heated to a preselected fixing temperature by a heater accommodated therein. The heat roller 14 and press roller 15 cooperate to fix the toner image carried on the paper by heating and pressing the paper. The paper with the fixed toner image is driven out to a tray not shown.

While the drum 2 is rotated clockwise, the charger 2 uniformly charges the surface of the drum 2. The optics 4 scans the charged surface of the drum 2 with a laser beam modulated by image data, thereby forming an electrostatic latent image on the drum 2. The developing unit 5 deposits toner on the latent image so as to transform the toner image to a corresponding toner image. The image transfer section 6 transfers the toner image from the drum 2 to the paper reached the nip between the drum 2 and the section 2. The paper with the toner image is driven out to the tray by way of the fixing section 13, as stated above.

The drum 2 is further rotated after the transfer of the toner image to the paper. The cleaning unit 7 scrapes off the toner left on the drum 2 after the image transfer. Then, the low friction agent applicator 9 applies a low friction agent T (see FIGS. 2 and 3) to the surface of the drum 2. Subsequently, the discharger 8 discharges the surface of the drum 2. The drum 2 is now ready to be again uniformly charged by the charger 3 for the next image formation.

The cleaning unit 7 includes a cleaning blade 16 for scraping off the toner left on the drum 2 after the image transfer. The cleaning blade 16 removes undesirable matters including NOx, SOx and other ion oxides from the surface of the drum 2 together with the toner.

Figure 2:
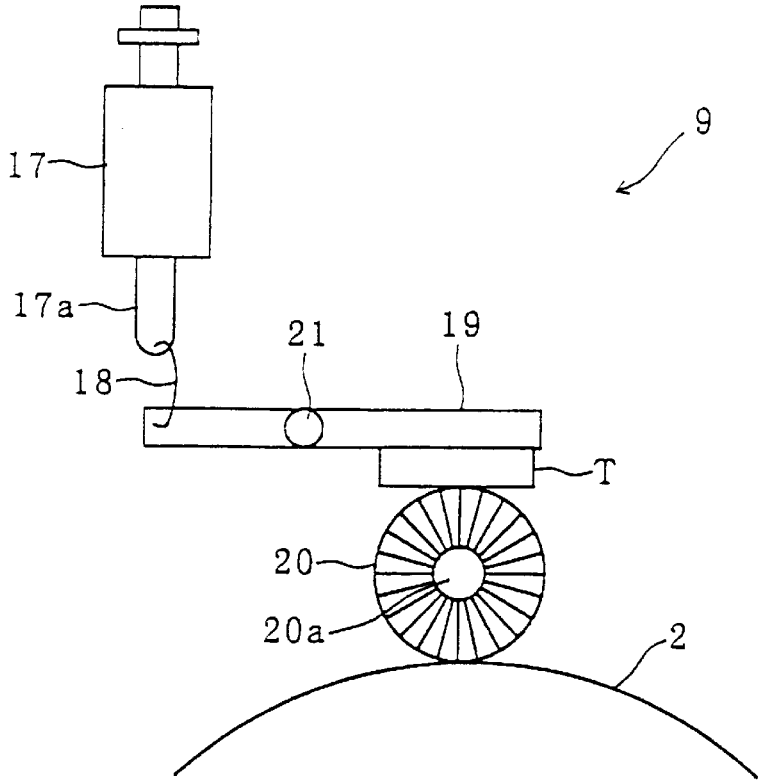
FIG. 2 shows a low friction agent applicator included in the illustrative embodiment in a condition applying a low friction agent to a photoconductive element.
Figure 3:
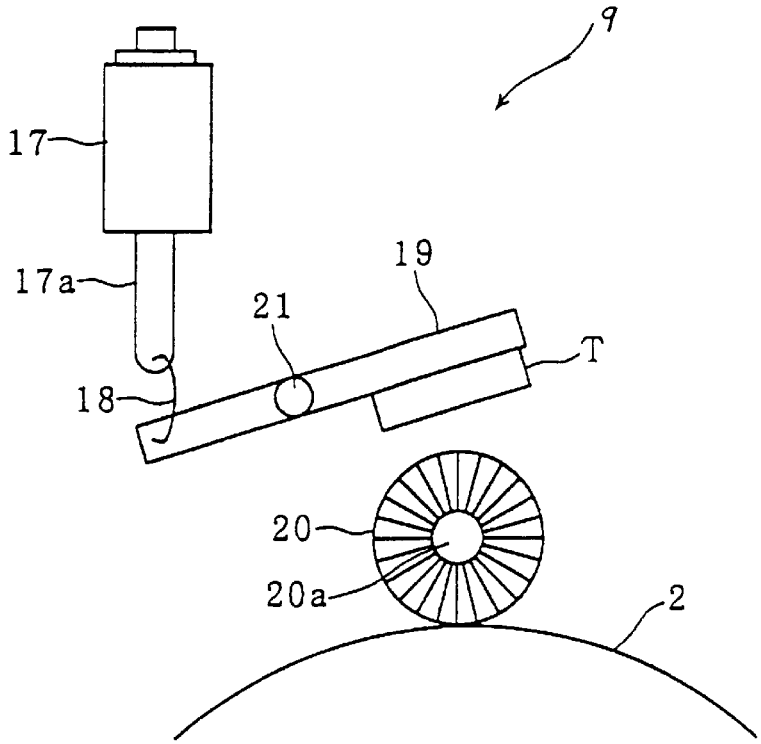
FIG. 3 is a view similar to FIG. 2, showing the low friction agent applicator stopped applying the agent to the photoconductive element.

FIGS. 2 and 3 show specific configuration of the low friction agent applicator 9. As shown, the applicator 9 includes an electromagnetic solenoid 17, a connecting member 18, an arm 19, and a charging brush 20. The arm 19 is rotatably supported by a shaft 21 substantially at its center and connected to the plunger 17*a* of the solenoid 17 by the connecting member 18 at its one end. The low friction agent or member T is mounted on the underside of the other end of the arm 19 facing the brush 20. The arm 19 is rotated about the shaft 21 when the solenoid 17 is turned on or turned off. The brush 20 is rotatably supported by a shaft 20*a* and rotated by the drum 2. The brush 20 starts or stops applying the low friction agent T to the drum 2 when the solenoid 17 is turned on or turned off.

Specifically, when the solenoid 17 is turned on, the plunger 17*a* is pulled into the solenoid 17, as shown in FIG.

2. As a result, the arm 19 brings the low friction member T into contact with the brush 20, causing the brush 20 to apply the member or agent T to the drum 2. As shown in FIG. 3, on the turn-off of the solenoid 17, the plunger 17*a* is thrust out and causes the arm 19 to release the low friction member T from the brush 20. As a result, the application of the agent T to the drum 2 ends.

The low friction agent T may be implemented by any suitable lubricating material in the form of liquid, solid or powder. For example, us may be made of silicone oil, fluorine oil or similar lubricating liquid, PTFE (Poly Tetra Fluoro Ethylene), PFA (Per Fluoro Alkoxy alkane), PVDF (Poly Vinylidene Fluoride) or similar fluorine-contained resin, silicone resin, silicone grease, fluorine grease, paraffin wax, zinc stearate or similar fatty acid metal salt, graphite, molybdenum disulfide or similar lubricating solid.

Referring again to FIG. 1, an image reader 22 and a defective image detector 23 are arranged around the drum 2. Also, an image reader 24 and a defective image detector 25 are arranged above the belt 11.

The image reader 22 is implemented by, e.g., a CCD (Charge Coupled Device) image sensor and positioned in the vicinity of the developing unit 5 in the direction of rotation of the drum 2. The image reader 22 reads a toner image formed on the drum 2 by the developing unit 5. The defective image detector 23 is implemented by a reflection type photosensor by way of example and precedes the cleaning unit 7 in the direction or rotation of the drum 2. The detector 23 is used to detect a defective image on the drum 2 by determining, e.g., whether or not an image is left on the drum 2 after image transfer or the density of the image.

The image reader 24 is also implemented by, e.g., a CCD image sensor and reads a toner image transferred from the drum 2 to the paper at the image transfer station 6. The defective image detector 25 is implemented by, e.g., a reflection type or transmission type photosensor and used to detect a defective image on the paper by determining, e.g., whether or not an image is present on the paper after the transfer of a toner image from the drum 2 to the paper or the density of the image.

Figure 4:
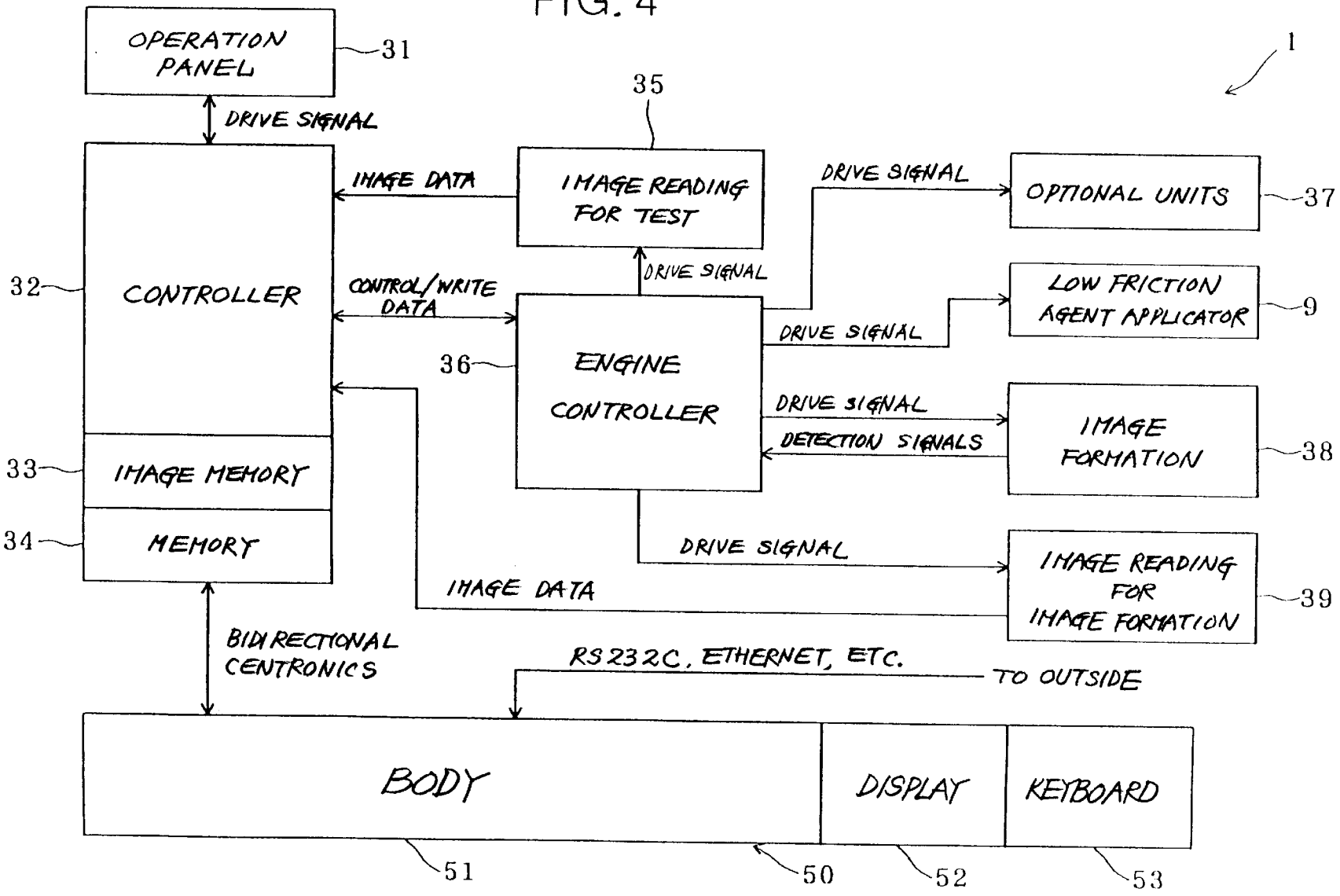
FIG. 4 is a block diagram schematically showing a control system included in the illustrative embodiment.

FIG. 4 shows a control system included in the illustrative embodiment. As shown, the control system includes an operation panel 31, a controller 32, an image memory 33, a font ROM (Read Only Memory) or similar memory 34, an image reading 35 for a test, an engine controller 36, an optional unit 37, the low friction agent applicator 9, an image formation 38, and an image reading 39 for image formation. The apparatus 1 is connected to a personal computer or similar image processing device 50 by, e. g., a bidirectional centronics. The apparatus 1 forms an image on a paper on the basis of image data input from the image processing device 50, image data output from the image reader 39 for image formation, or image data for evaluation or image data representative of a test pattern stored in the image memory or the memory 34 beforehand.

The image processing device 50 includes a body 51, a display 52, and a keyboard 53. When the device is a personal computer, the body 51 is representative of the body of the computer. The device 50 may be connected to RS-232C or Ethernet in order to interchange image data with other image processing devices. In this condition, the device 50 sends image data prepared thereon or received from another image processing device to the apparatus 1.

Various keys are arranged on the operation panel 31, as usual. Particularly, in the illustrative embodiment, a key for adjusting the amount of the low friction agent T to be applied to the drum 2 is provided on the operation panel 31. Also provided on the keyboard 31 is an LCD (Liquid Crystal Display) or similar display. The operator performs various kinds of operation, including the adjustment of the amount of the low friction agent T, on the panel 31. Commands input on the operation panel 31 or various kinds of information reported from the apparatus 1 to the operator appear on the display.

The controller 32 executes basic processing particular to the apparatus 1 by controlling the various sections of the apparatus 1. In addition, the controller 32 executes the adjustment of the amount of the low friction agent T to be applied to the drum 2, as will be described in detail later. The image memory 33 implemented by a hard disk by way of example stores, under the control of the controller 32, image data read by the image reading 39 out of a document or image data received from the image processing device 50.

The image reading 35 for a test is representative of the image reader 22, defective image detector 23, image reader 24 and defective image detector 25 and feeds read image data and image information to the controller 32. The engine controller 36 operates under the control of the controller 36 for controlling the drive of the image reading 35 for a test, optional unit 37, low friction agent applicator 9, image formation 38, and image reading 39 for image formation. The optional unit 37 is representative of an ADF (Automatic Document Feeder) and other units which may be optionally mounted to the apparatus 1.

The low friction applicator 9 selectively turns on or turns off the solenoid 17 in response to a drive signal output from the engine controller 36, thereby starting or ending the application of the low friction agent T to the drum 2. The image formation 38 is representative of the drum 2, charger 3, optics 4, developing unit 5, image transfer section 6, cleaning unit 7, discharger 8 and so forth necessary for image formation. The image formation 38 forms an image on a paper under the control of the engine controller 36. The image reading 39 implemented by a CCD image sensor by way of example reads an image out of a document with a preselected resolution.

The operation of the illustrative embodiment will be described hereinafter. Briefly, the apparatus is characterized in that it applies the low friction agent T to the drum 2 while adequately adjusting the amount of the agent T to be applied on the basis of an image formed on the drum 2 and an image formed on a paper. When the agent T is applied to the drum 2, it is likely to degrade image quality if its amount is inadequate. Specifically, when the toner is fed from the developing section 5 to the drum 2 for development, the agent T is likely to reduce the adhesion between the toner and the drum 2 and prevent the toner from being adequately transferred to the drum 2. In addition, the agent T is likely to reduce the coefficient of friction and therefore a shearing force acting between the photoconductive layer of the drum 2 and the cleaning blade 16, making it difficult for the blade 16 to remove ion oxides and other undesirable matters from the drum 2.

Figure 5:
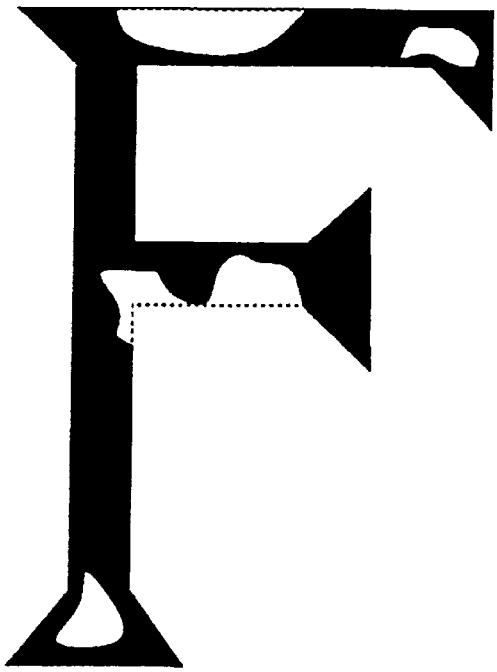
FIGS. 5–7 each shows a specific defective image.
Figure 6:
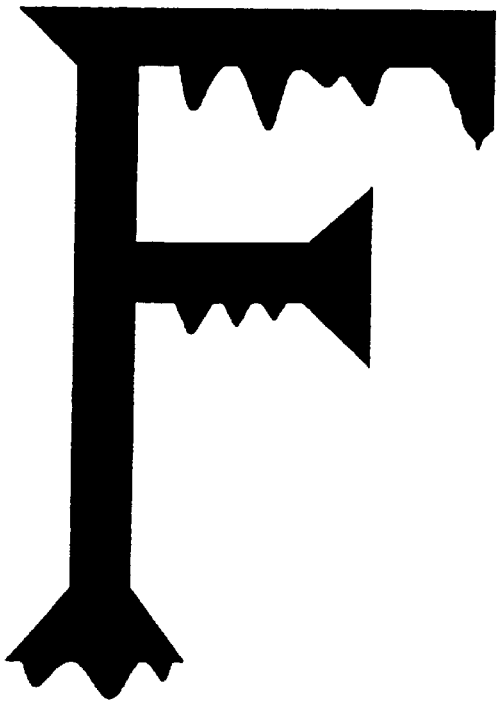

FIGS. 5 and 6 each shows a specific defective image ascribable to the above defective transfer of the toner from the developing section to the drum 2 at the time of development. In FIG. 5, a letter F developed in black, but locally lost, is shown. In FIG. 6, a letter F also developed in black, but partly caused to run, is shown.

Figure 7:
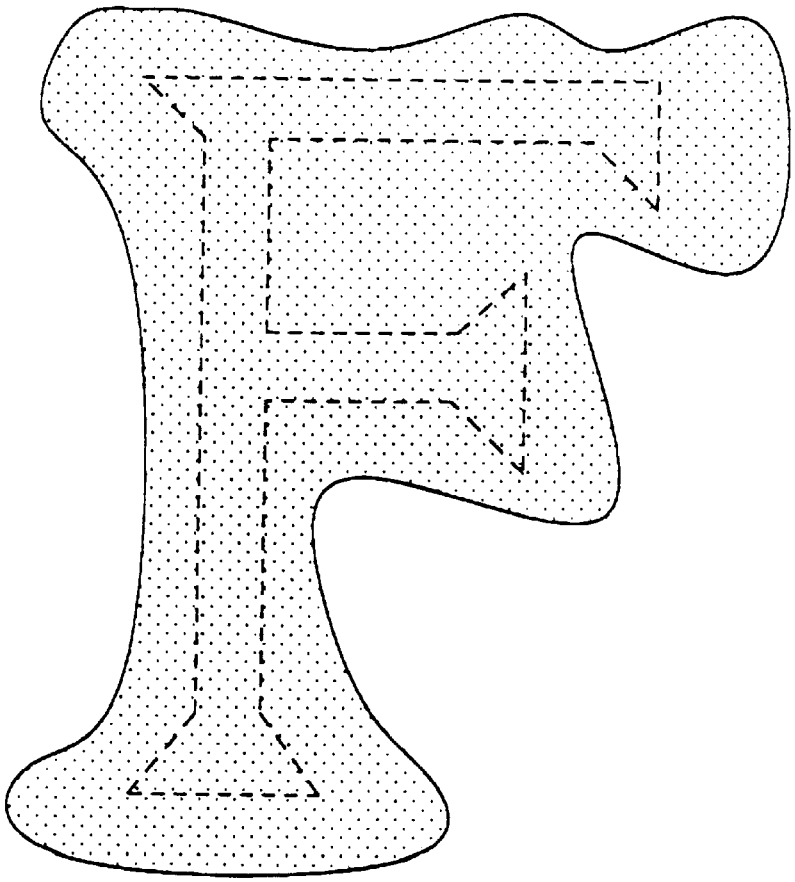
Figure 8:
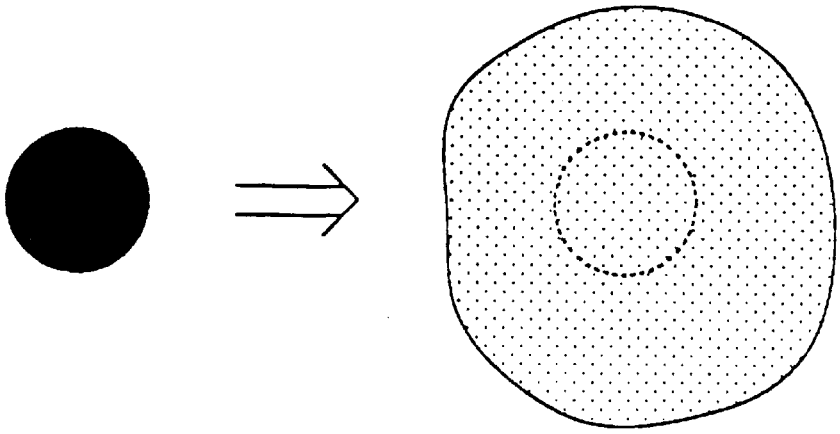
FIG. 8 shows a specific original black image and a blurred image derived from the original image.
Figure 9:
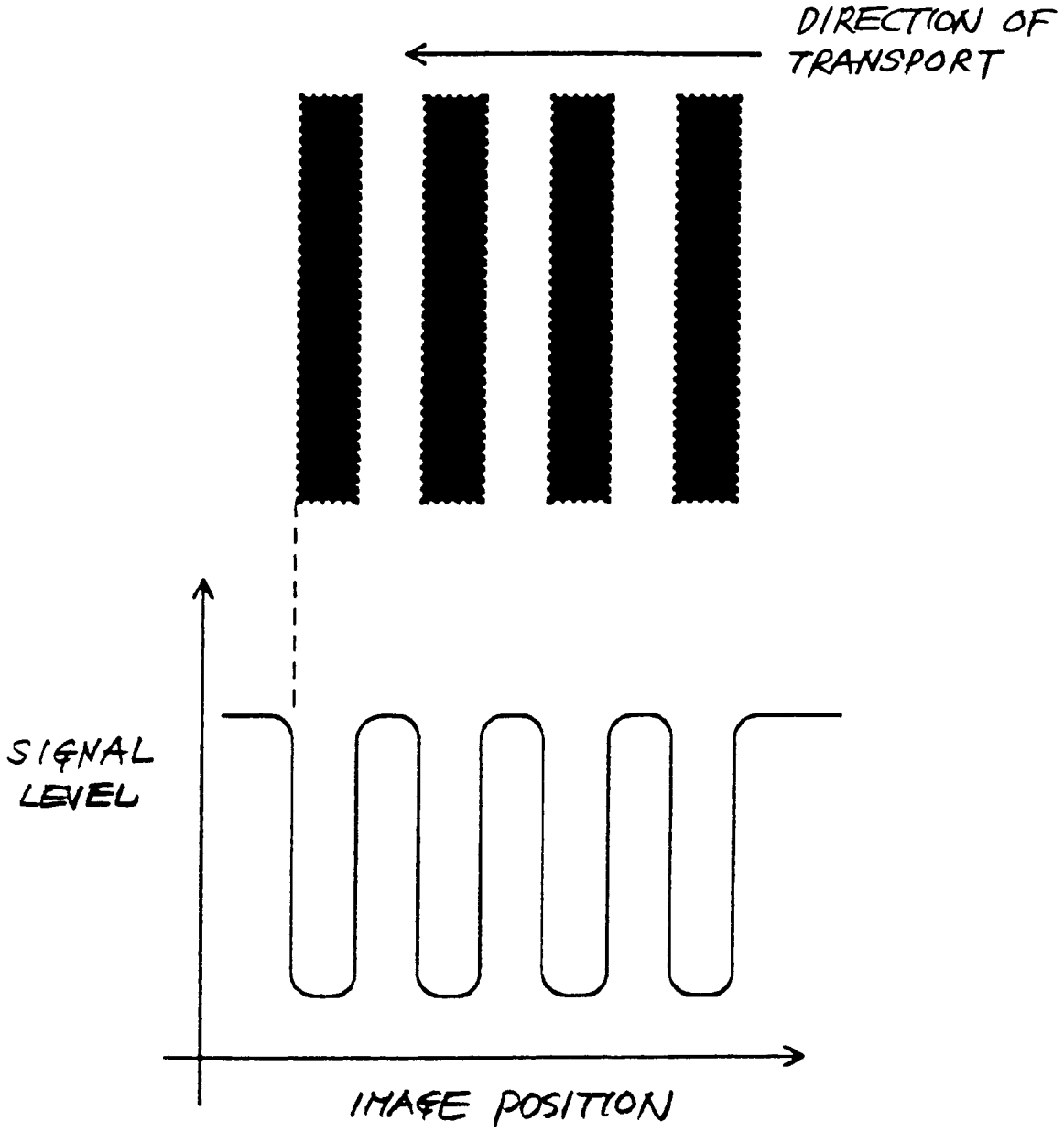
FIG. 9 shows specific original dense lines and the output of a defective image detector included in the illustrative embodiment and representative of the dense lines.
Figure 10:
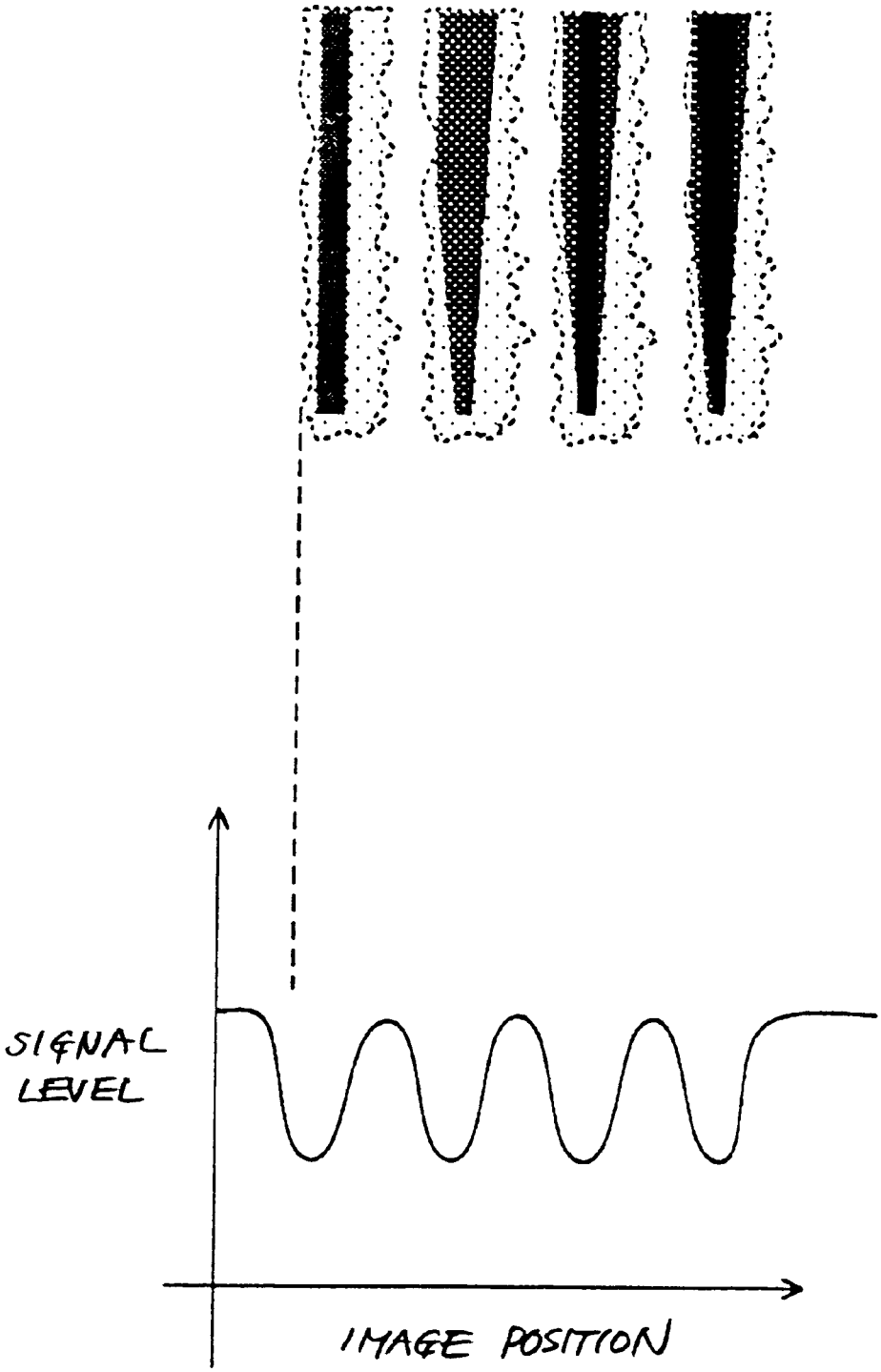
FIG. 10 shows dense lines corresponding to the dense lines of FIG. 9, but blurred, and the resulting output of the defective image detector.

FIGS. 7–19 each shows a specific defective image ascribable to a decrease in the coefficient of friction between the drum 2 and the cleaning blade 16. In FIG. 7, a letter F developed in black, but blurred, is shown. In FIG. 8, a black blurred image is shown. Further, FIG. 9 shows expected dense lines and an arrow indicative of the direction of rotation of the drum 2. FIG. 10 shows an image corresponding to the image of FIG. 9, but blurred at the borders between the lines.

The above defective images do not occur suddenly in a two-level fashion, i.e., when the coefficient of friction of the drum 2 decreases to a certain value. That is, images sequentially vary in accordance with the variation of the coefficient of friction of the surface of the drum 2 and appear defective to the eye when varied over a certain degree.

The apparatus 1 allows the operator of the apparatus 1 to see an image printed on a paper and then operate the adjusting key on the operation panel 31 in order to adjust the amount of the agent T to be applied from the applicator 9 to the drum 2. Also, the apparatus 1 is capable of automatically adjusting the amount of the agent T on the basis of image information representative of a toner image read by the image reader 22 and a toner image read by the image reader 24 or on the basis of a toner image detected by the defective image detector 23 and a toner image detected by the defective image detector 25.

First, how the operator operates the operation panel 31 in order to adjust the amount of the agent T will be described. The operator determines the quality of an image printed on a paper by the apparatus 1 and then increases or decreases the amount of the agent T on the operation panel 31. In response, the controller 32 writes the value input on the operation panel 31 in a RAM (Random Access Memory) built therein or in the memory 34. Then, the controller 32 turns on and off the solenoid 17 in order to apply the agent T to the drum 2 by an amount corresponding to the above value.

Figure 11:
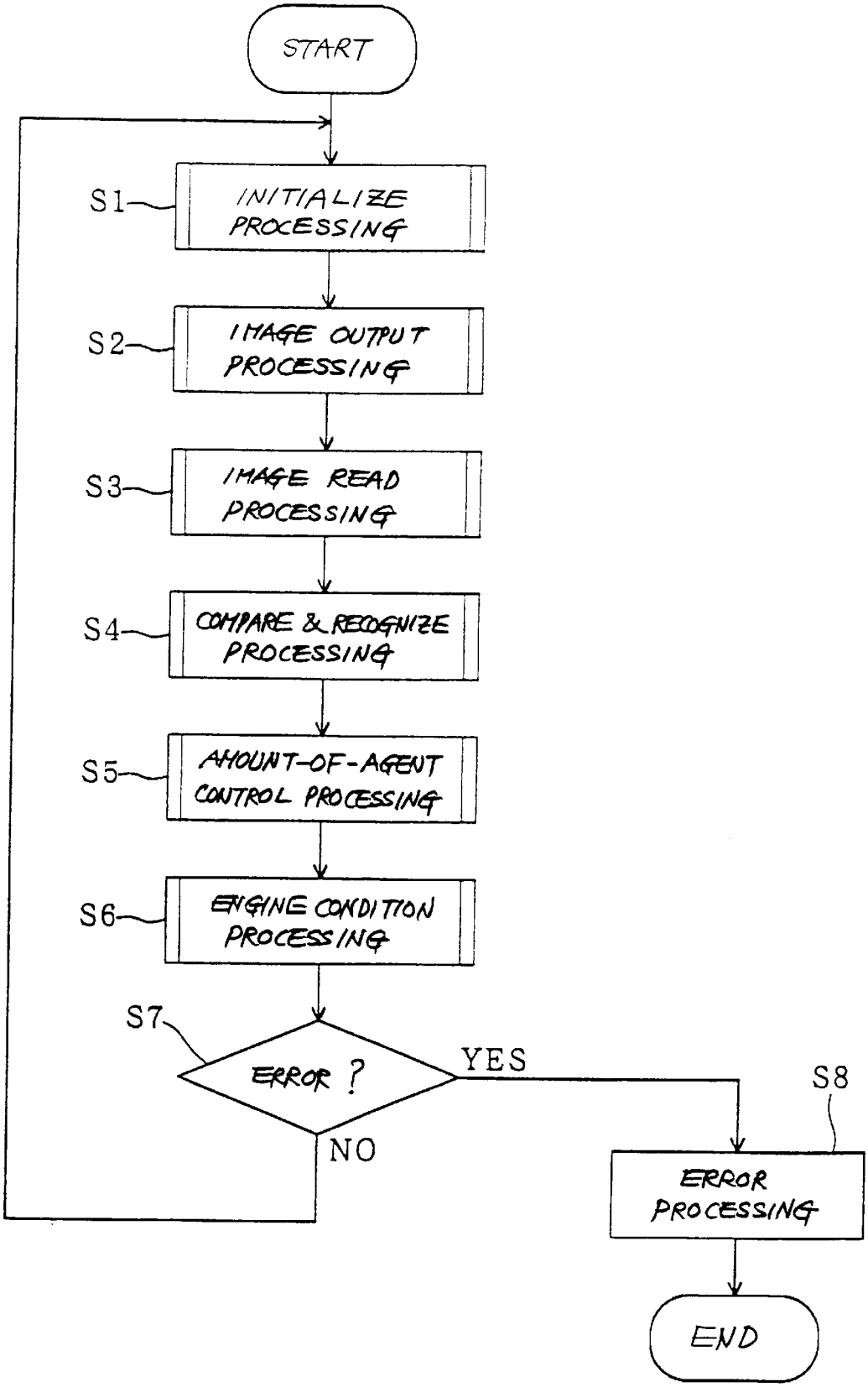
FIG. 11 is a flowchart demonstrating a specific operation of the illustrative embodiment.

The automatic adjustment of the agent T based on the image data representative of toner images formed on the drum 2 and paper, respectively, is as follows. First, an automatic adjustment procedure based on the outputs of the image readers 22 and 24 responsive to toner images formed on the drum 2 and paper, respectively, will be described with reference to FIGS. 11–16. As shown in FIG. 11, the controller 32 executes initialization (step S1) and then sequentially executes image output processing (step S2), image read processing (step S3), compare and recognize processing (step S4), amount-of-agent control processing (step S5), and engine condition processing (step S6). After the step S6, the controller 32 determines whether or not an error has occurred (step S7). If the answer of the step S7 is negative (NO), then the controller 32 returns to the step S1. If the answer of the step S7 is positive (YES), e.g., if a paper jam has occurred, then the controller 32 executes error processing and stops the operation of the apparatus 1 (step S8). This is the main routine of the controller 32.

Figure 12:
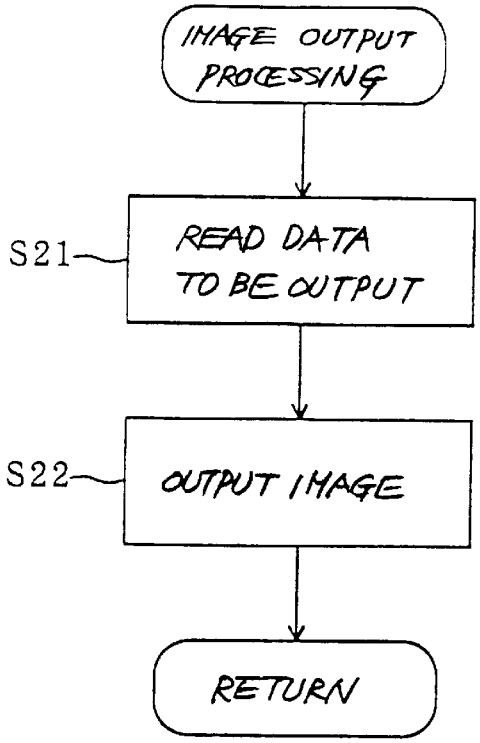
FIGS. 12–16 each shows a particular step included in the flowchart of FIG. 11 specifically.
Figure 13:
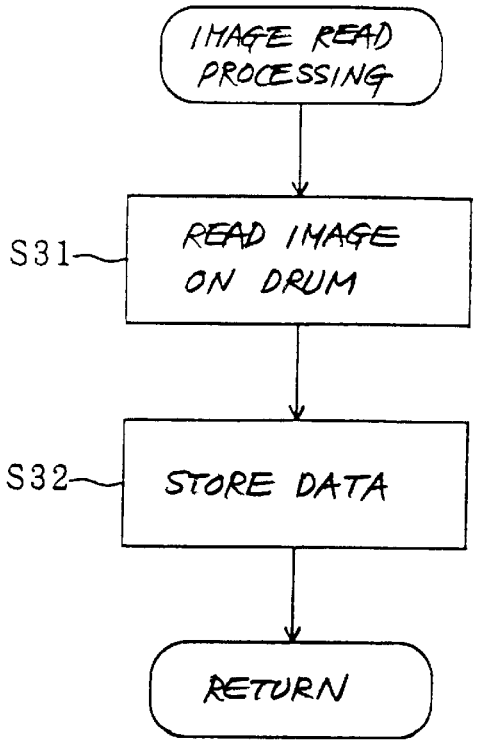

FIG. 12 demonstrates the step S2 of FIG. 11, i.e., usual image formation specifically. As shown, the controller 32 reads image data (data to be output) stored in the image memory 33 beforehand (step S21). Of course, such image data for evaluation may be image data representative of a document read by the image reading 39 or image data received from the image processing device 50. In any case, the image data is held in the image memory 33, so that it can be compared with image data read in the step S3 of FIG. 11 in the step S4.

After the step S21, the controller 32 sends the image data to the image formation 38. The optics 4 of the image formation 38 scans the drum 2 with a laser beam while modulating it with the received image data, thereby forming a latent image on the drum 2. The latent image is developed by the developing unit 5 and then transferred to a paper by the image transfer section 6. This procedure is collectively represented by a step S22. After the image transfer, the cleaning unit 7 removes the toner left on the drum 2, and then the applicator 9 applies the low friction agent T to the drum 2. Thereafter, the drum 2 is discharged by the discharger 8 and again uniformly charged by the charger 3 to prepare for the next image formation.

The step 53 of FIG. 11 includes the function of the image reader 22 responsive to the toner image formed on the drum 2 and the function of the image reader 24 responsive to the toner image transferred to the paper. The function of the image reader 22 will be described first with reference to FIG. 13. As shown, the image reader 22 reads the toner image formed on the drum 2 and sends the resulting image data to the controller 32 (step S31). The controller 32 writes the received image data in the image memory 33 or the RAM of the controller 31 as data to be compared and ends image read processing (step S32).

Figure 14:
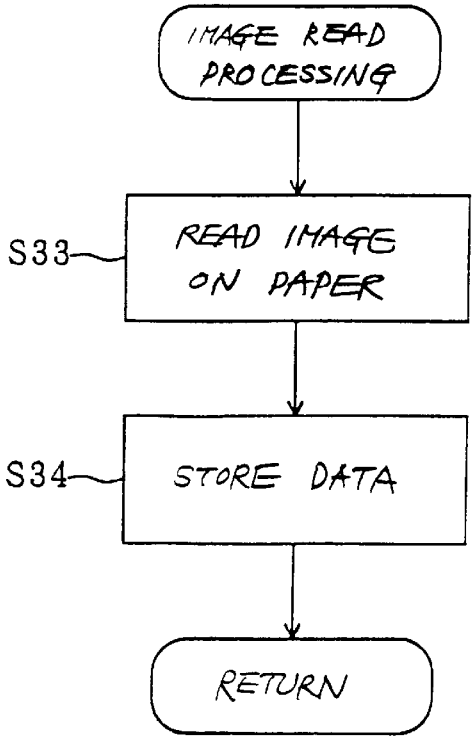

As shown in FIG. 14, the other image reader 24 reads the toner image transferred from the drum 2 to the paper being conveyed by the belt 11 and sends the resulting image data to the controller 32 (step S33). The controller 32 again writes the received image data in the image memory 33 or the RAM of the controller 31 as data to be compared and ends image read processing (step S34).

Figure 15:
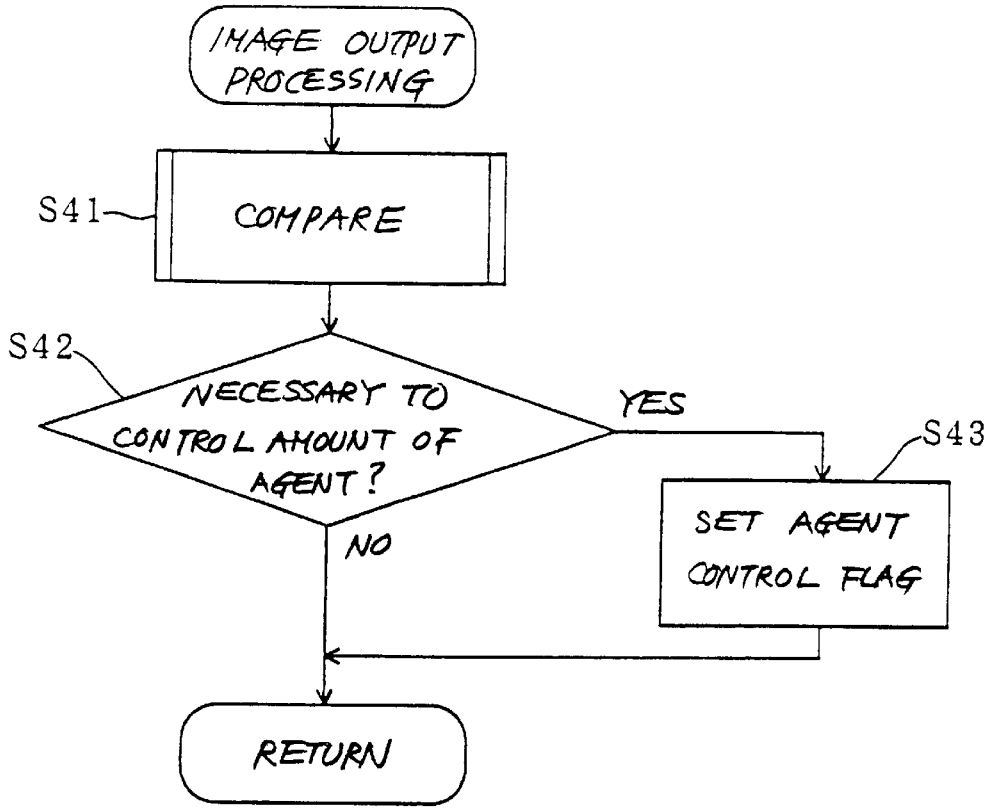

FIG. 15 shows the compare and recognize processing in step S4 in detail. As shown, the controller 32 compares the original image and the images to be compared (step S41) and determines, based on any suitable rule, whether or not the amount of the agent T to be applied should be controlled (step S42). Specifically, the controller 32 compares the image data output from the image readers 22 and 24 and the original image data in order to determine, e.g., whether or not the data to be compared are partly lost or excessive. More specifically, the controller 32 determines whether or not a black image is locally lost (FIG. 5), whether or not a black image has run (FIG. 6), or whether or not a black image as been blurred (FIG. 7 or 8). Then, the controller 32 determines whether or not the amount of the agent T to be applied should be controlled. This is because the above defective images do not occur suddenly in a two-level fashion, i.e., when the coefficient of friction of the drum 2 decreases to a certain value, as stated earlier.

If the amount of the agent T does not have to be controlled (NO, step S42), then the controller 32 ends the compare and recognize processing. If the amount of the agent T has to be controlled (YES, step S42), then the controller 32 sets an agent control flag and ends the above processing (step S43).

Figure 16:
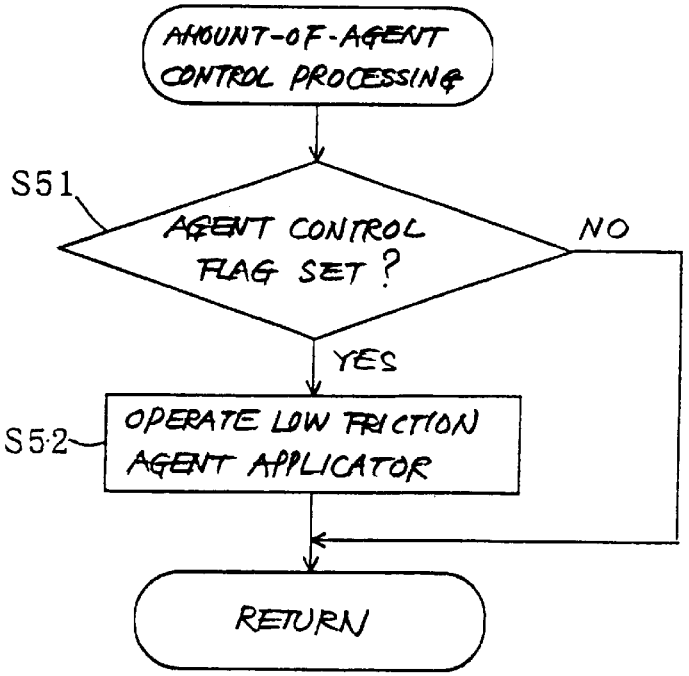

The step S5 of FIG. 11 for adjusting the amount of the agent T via the applicator 9 is shown in FIG. 16 specifically. As shown, the controller 32 determines whether or not the agent control flag is set (step S51). If the answer of the step S51 is NO, then the controller 32 ends the procedure without varying the amount of the agent T to be applied to the drum 2

If the answer of the above step S51 is YES, then the controller 32 controls the applicator 9 via the engine controller 36 and causes it to vary the amount of the agent T and ends the procedure (step S52). Specifically, the controller 32 adjusts the interval between the ON state and the OFF state of the solenoid 17 of the applicator 9 via the engine controller 36. As a result, the duration of contact of the agent T with the brush 20 and therefore the amount of the agent T to be applied to the drum 2 is adjusted. This successfully enhances image quality.

Reference will be made to FIGS. 17–21 for describing an automatic adjustment procedure based on image data output from the defective image detectors 23 and 25. In this case, the controller 32 executes a main routine shown in FIG. 17. As shown, the controller 32 sequentially executes, after initialization (step P1), test pattern output processing (step P2), image data read processing (step P3), read data analyze processing (step P4), amount-of-agent control processing (step P5), and engine condition processing (step P6). After the step P6, the controller 32 determines whether or not an error has occurred (step P7). If the answer of the step P7 is NO, then the controller 32 returns to the step P1. If the answer of the step S7 is YES, e.g., if a paper jam has occurred, then the controller 32 executes error processing and stops the operation of the apparatus 1 (step P8).

Figure 18:
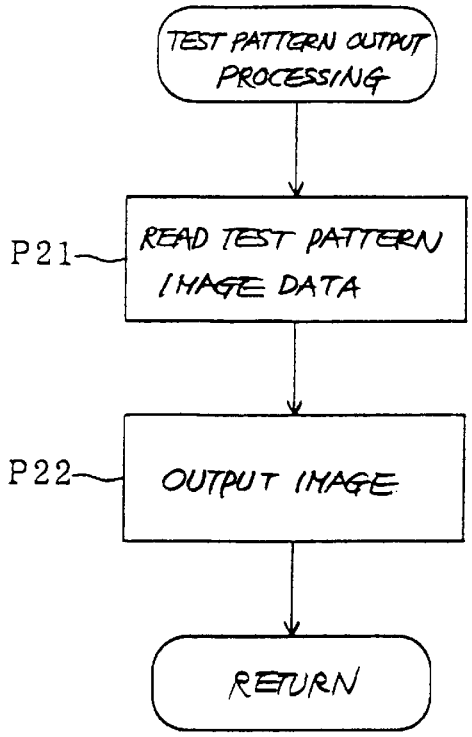
FIGS. 18–21 each shows a particular step included in the flowchart of FIG. 17 specifically.
Figure 19:
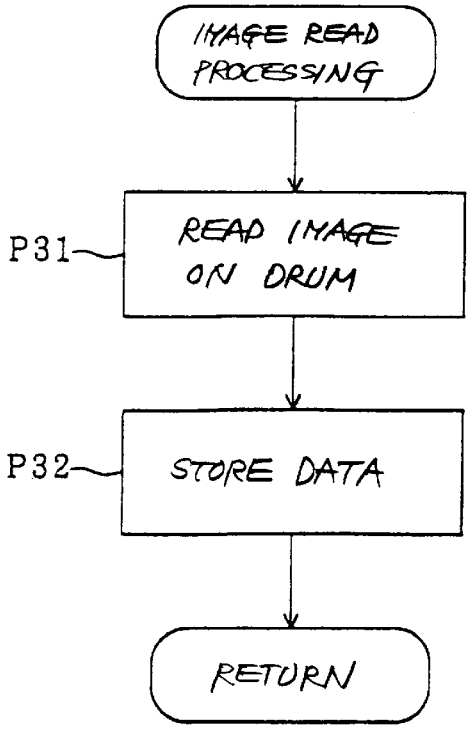

The above step P2 in which the apparatus 1 records a test pattern is shown in FIG. 18 specifically. As shown, the controller 32 reads test pattern image data for evaluation stored in its ROM, memory 34 or image memory 33 beforehand (step P21). The test pattern image data are representative of an image suitable for the evaluation of an image formed by the image forming section 38, e.g., the dense lines shown in FIG. 9.

After the step P21, the controller 32 transfers the image data to the image formation 38. The optics 4 of the image formation 38 scans the drum 2 with a laser beam while modulating it with the received image data, thereby forming a latent image on the drum 2. The latent image is developed by the developing unit 5 and then transferred to a paper by the image transfer section 6. This procedure is collectively represented by a step P22. After the image transfer, the cleaning unit 7 removes the toner left on the drum 2, and then the applicator 9 applies the low friction agent T to the drum 2. Thereafter, the drum 2 is discharged by the discharger 8 and again uniformly charged by the charger 3 to prepare for the next image formation.

Figure 17:
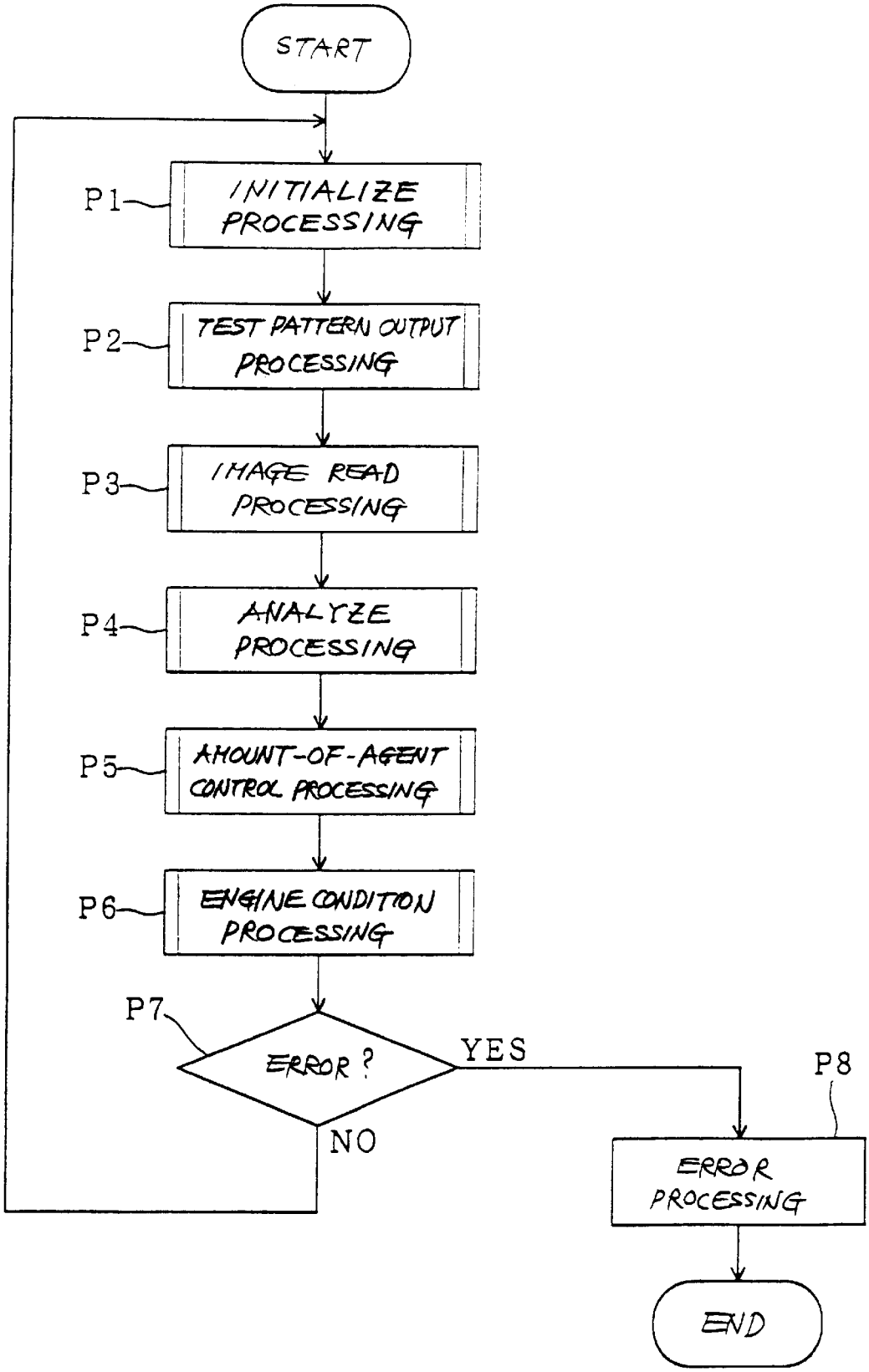
FIG. 17 is a flowchart showing another specific operation of the illustrative embodiment.

The step P3 of FIG. 17 includes the function of the defective image detector 23 responsive to the toner image formed on the drum 2 and the function of the defective image detector 25 responsive to the toner image transferred to the paper. The function of the defective image detector 23 will be described first with reference to FIG. 19. As shown, the defective image detector 23 detects the toner image formed on the drum 2 by the developing section 5 and representative of the test pattern and sends the resulting image data to the controller 32 (step P31). The controller 32 writes the image data received from the detector 23 in the image memory 33 or the RAM of the controller 31 as data to be compared and then ends the image data read processing (step P32).

Figure 20:
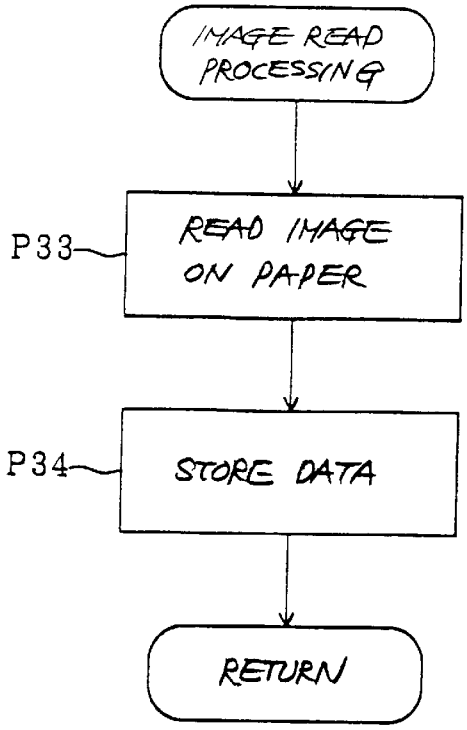

As shown in FIG. 20, the other defective image detector 25 detects the toner image transferred to the paper being conveyed by the belt 11 and representative of the test pattern and sends the resulting image data to the controller 32 (step P33). The controller 32 again writes the image data received from the detector 25 in the image memory 33 or the RAM of the controller 31 as data to be compared and then ends the image data read processing (step P34).

Figure 21:
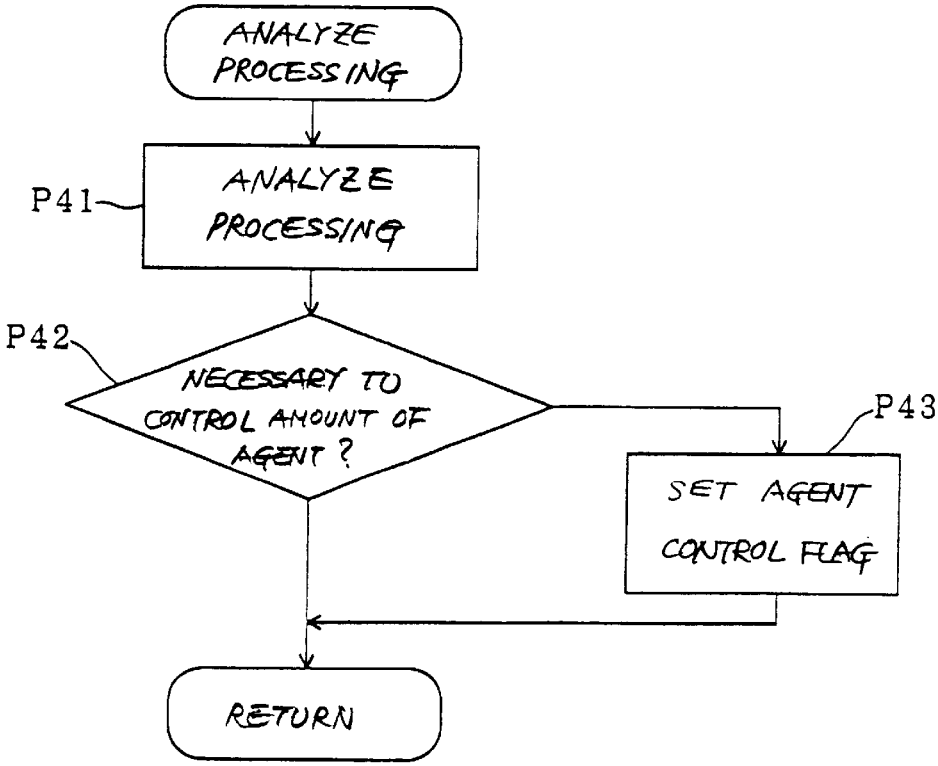

FIG. 21 shows the step P4, FIG. 17, for analyzing the image data specifically. As shown, the controller 32 analyzes the image data output from the defective image detectors 23 and 25 (step P41). Then, the controller 32 determines, based on any desired rule, whether or not the amount of the agent T to be applied to the drum 2 should be controlled (step P42).

Specifically, the controller 32 analyzes the image data received from the defective image detectors 23 and 25. For example, the controller 32 determines whether or not the black image has been blurred, as shown in FIG. 7 or 8, or whether or not the dense lines of FIG. 9 have been blurred, as shown in FIG. 10. As for the original dense lines shown in FIG. 9, the signal levels output from the detectors 23 and 25 each sharply rises and falls in accordance with the image position, i.e., falls at black portions due to light absorption or rises at white portions, as also shown in FIG. 9. However, when the dense lines are blurred, as shown in FIG. 10, each signal level does not sharply vary, as also shown in FIG. 10.

The controller 32 determines, based on the result of the above analysis, whether or not the toner image is defective and therefore whether or not the amount of the agent T should be controlled, by using any suitable rule. Specifically, the defective images do not occur suddenly in a two-level fashion, i.e., when the coefficient of friction of the drum 2 decreases to a certain value. That is, images sequentially vary in accordance with the variation of the coefficient of friction of the surface of the drum 2 and appear defective to the eye when varied over a certain degree, as stated earlier. In light of this, the controller 32 makes the above decision. For the decision, the controller 32 may compare the signals output from the detectors 23 and 25 with preselected threshold values.

If the answer of the step S42 is NO, then the controller 32 ends the compare and recognize processing. If the answer of the step S42 is YES, then the controller 32 sets the agent control flag and then ends the processing (step P43). The step P5 shown in FIG. 17 is identical with the procedure described with reference to FIG. 16 and will not be described specifically in order to avoid redundancy. In this manner, the controller 32 analyzes image data output from the defective image detectors 23 and 25 in order to determine whether or not the current amount of the agent T to be applied to the drum 2 is adequate. This is successful to adequately control the amount of the agent T and therefore image quality.

In the illustrative embodiment, the amount of the agent T is adjusted in accordance with both of the image data output from the image readers 22 and 24 and the image data output from the defective image detectors 23 and 25. If desired, only one of the image data output from the image readers 22 and 24 and the image data output from the defective image detectors 23 and 25 may be used. Further, only the toner image formed on the drum 2 or the toner image transferred to the paper may be read.

In summary, it will be seen that the present invention provides an image forming apparatus capable of applying a low friction agent to a photoconductive element within a range insuring high image quality. This extends the life of the photoconductive element and enhances image quality. Further, the apparatus of the present invention is capable of detecting a toner image with a simple, inexpensive and compact construction.

Various modifications will become possible for those skilled in the art after receiving the teachings of the present disclosure without departing from the scope thereof.

What is claimed is:

1. An image forming apparatus for forming an electrostatic latent image on a uniformly charged photoconductive element with a laser beam modulated in accordance with original image data, feeding toner to said photoconductive element to thereby produce a toner image corresponding to said latent image, transferring said toner image to a recording medium, and removing the toner left on said photoconductive element after image transfer to the recording medium, said image forming apparatus comprising:

an applicator configured to apply a preselected low friction agent to a surface of said photoconductive element;

an adjusting mechanism configured to adjust an amount of said low friction agent to be applied to the surface of said photoconductive element by said applicator;

an image reading device configured to read at least one of the toner image formed on said photoconductive element and the toner image transferred to the recording medium; and a controller configured to compare toner image data output from said image reading device and the original image data to determine whether or not the toner image read by said image reading device is defective based on the comparing, and to control based on a result of decision, the amount of said low friction agent to be applied to the surface of said photoconductive element via said adjusting mechanism.

2. An image forming apparatus for forming an electrostatic latent image on a uniformly charged photoconductive element with a laser beam modulated in accordance with original image data, feeding toner to said photoconductive element to thereby produce a toner image corresponding to said latent image, transferring said toner image to a recording medium, and removing the toner left on said photoconductive element after image transfer to the recording medium, said image forming apparatus comprising:

an applicator configured to apply a preselected low friction agent to a surface of said photoconductive element;

an adjusting mechanism configured to adjust an amount of said low friction agent to be applied to the surface of said photoconductive element by said applicator;

an image detecting mechanism configured to detect at least one of the toner image formed on said photoconductive element and the toner image transferred to the recording medium; and a controller configured to determine by analyzing the toner image detected by said image data detecting mechanism whether or not the toner image detected by said image detecting mechanism is defective by deciding whether the toner image detected by said image detecting mechanism is blurred, and to control based on a result of the decision, the amount of said low friction agent to be applied to the surface of said photoconductive element via said adjusting mechanism.

3. The image forming apparatus of claim 2, wherein said image data detecting mechanism comprises a photosensor configured to sense a density and one of a reflectance and transmissivity of the toner image, and said controller is further configured to compare an output signal of said photosensor and a preselected threshold value.

4. A method for forming an electrostatic latent image on a uniformly charged photoconductive element with a laser beam modulated in accordance with original image data, comprising the steps:

applying a preselected low friction agent to a surface of said photoconductive element;

adjusting an amount of said low friction agent to be applied to the surface of said photoconductive element;

reading at least one of a toner image formed on said photoconductive element and a toner image transferred to a recording medium;

determining by comparison whether the toner image read in the reading step is defective by comparing read toner image data and the original image data; and, controlling the amount of said low friction agent to be applied to the surface of said photoconductive element based on a result of the determining step.

5. A method for forming an electrostatic latent image on a uniformly charged photoconductive element with a laser beam modulated in accordance with original image data, comprising the steps:

applying a preselected low friction agent to a surface of said photoconductive element;

adjusting an amount of said low friction agent to be applied to the surface of said photoconductive element;

detecting at least one of a toner image formed on said photoconductive element and a toner image transferred to a recording medium;

determining the toner image detected in the detecting step is defective by deciding whether the toner image detected in the detecting step is blurred; and, controlling the amount of said low friction agent to be applied to the surface of said photoconductive element based on a result of the determining step.

6. The method of claim 5, wherein:

said detecting step comprises sensing a density and one of a reflectance and transmissivity and producing an output signal representative of said sensing; and, said determining step comprises comparing the output signal and a preselected threshold value.

* * * * *